US011266277B2

(12) United States Patent
Pang et al.

(10) Patent No.: US 11,266,277 B2
(45) Date of Patent: Mar. 8, 2022

(54) URINE DEFLECTOR

(71) Applicant: RAZ DESIGN INC., Toronto (CA)

(72) Inventors: Nelson Pang, Toronto (CA); David Harding, Toronto (CA); Robert Vandenham, Woodbridge (CA); Xiao B. Yi, North York (CA)

(73) Assignee: RAZ DESIGN INC., Toronto (CA)

( * ) Notice: Subject to any disclaimer, the term of this patent is extended or adjusted under 35 U.S.C. 154(b) by 0 days.

(21) Appl. No.: 16/938,440

(22) Filed: Jul. 24, 2020

(65) Prior Publication Data

US 2021/0045593 A1 Feb. 18, 2021

(30) Foreign Application Priority Data

Aug. 16, 2019 (CA) ..... CA 3052365

(51) Int. Cl.
*A47K 13/24* (2006.01)
*E03D 9/00* (2006.01)

(52) U.S. Cl.
CPC ..... *A47K 13/24* (2013.01); *E03D 9/00* (2013.01)

(58) Field of Classification Search
CPC ..... A47K 13/24
USPC ..... 4/300.3, 300, 415
See application file for complete search history.

(56) References Cited

U.S. PATENT DOCUMENTS 1,879,066 A 9/1932 Bryant
2,113,705 A * 4/1938 Merrett ..... A47K 13/24 4/237
D139,221 S 10/1944 Bloom
2,709,816 A 6/1955 Lamb
2,955,296 A 10/1960 Zapolski
4,550,455 A 11/1985 Carson et al.
4,716,602 A 1/1988 Brickhouse
5,077,840 A * 1/1992 Masters ..... A47K 13/08 4/300.3
6,408,447 B1 * 6/2002 Burbank ..... A47K 13/24 4/300.3
6,874,171 B2 4/2005 Erves
7,007,313 B1 * 3/2006 Johnson ..... A47K 13/24 4/300.3

(Continued)

FOREIGN PATENT DOCUMENTS

DE 202 02 384 U1 10/2002

OTHER PUBLICATIONS

Extended European Search Report dated Jan. 12, 2021 from European Application No. 20191223.5.

*Primary Examiner* — Lori L Baker
(74) *Attorney, Agent, or Firm* — Fay Sharpe LLP

(57) ABSTRACT

A urine deflector to deflect urine issuing from a seated user, the urine deflector has at least one retaining projection extending from a urine deflector body portion, where the retaining projection is sized and shaped to be positioned and then held in place between a medial aspect of the user's legs and a toilet seat. The deflector body portion is sized and shaped to contain and direct a flow of urine emanating from said user generally downwardly, The urine deflector can be thus held in position between said user and a toilet seat in front of said user's genitals to prevent said flow of urine from escaping beyond said urine deflector in any direction except downwardly. The retaining projections may be flexible, include a living hinge or a hinge pin to facilitate positioning the retaining projection under the legs of a user.

16 Claims, 9 Drawing Sheets

(56) References Cited

U.S. PATENT DOCUMENTS

| | | | | |
|---|---|---|---|---|
| 7,461,411 | B2 | 12/2008 | Wolf | |
| 7,461,413 | B2 | 12/2008 | Lewis et al. | |
| 7,870,619 | B2 | 1/2011 | Conrad, III et al. | |
| D660,406 | S | 5/2012 | Thom et al. | |
| 2004/0215105 | A1 | 10/2004 | Maples | |
| 2006/0260031 | A1 | 11/2006 | Conrad, III | |
| 2007/0204391 | A1 | 9/2007 | Marra | |
| 2008/0263756 | A1 | 10/2008 | Marsden | |
| 2010/0263115 | A1* | 10/2010 | Thom ..... | A47K 13/005 4/300.3 |

* cited by examiner

URINE DEFLECTOR

FIELD OF THE INVENTION

This invention relates generally to the human toileting field. More particularly this invention relates to a deflector for urine control for a seated user or person.

BACKGROUND OF THE INVENTION

Controlling the direction of the excretion of urine for sanitary reasons is a basic skill practiced by most everyone. However, some individuals are not capable of practicing this basic skill. For example, individuals with physical disabilities may not have the capacity to direct their urine flow either into a toilet or other container designed to hold the expelled urine. People with cognitive disabilities may have similar limitations. Young children may not yet have learned how to recognize and control their bodily functions and may need a device to help direct their urine flow.

One approach for invalids is to use a bed pan which permits the invalid to remain in bed and to urinate into a small vessel in a controlled manner. However, other individuals use a toilet or commode chair while urinating. Depending upon the level of their physical or cognitive disability they may or may not be able to direct or control their urine stream. Again, depending upon the degree of physical and/or cognitive disability, they may or may not be able to stand and thus may also have to sit to urinate.

Urine deflectors are known in the prior art. For example, U.S. Design Patent 139,221, which is entitled Urine Deflector designed by Bloom, shows a urine deflector which includes two side attachment arms, each having a fastener hole, presumably for screws, bolts, rivets or pins, or other method of attaching the deflector to a horizontal surface. The arms are attached to a curved center piece which has an open top. A stream of urine issuing from above directed at the deflector will be directed downwardly, presumably into a receptacle, such as a toilet bowl, below. However, to function in this manner, the deflector must be attached at the back of the toilet bowl, which is of no use then if the patient is seated on the toilet facing forward. Due to the open top the Bloom deflector is of no use to a seated patient as it cannot contain the urine stream if directed upwardly or forwardly at the deflector.

For seated patients, a device such as that shown in U.S. Pat. No. 6,408,447 to Burbank et al. (Burbank) can be used. This is a device which can be attached to the toilet seat once the patient is seated and is for deflecting an outwardly directed urine stream downwardly into the toilet bowl by means of a curved deflector portion which is located between the user's legs. However, this device is awkward to use as it must be attached to the toilet seat. Thus, any adjustment of position of the user can cause the device to become misaligned relative to the user. Several embodiments are disclosed in this patent, including a clip attachment to the toilet seat, a clamp attachment to accommodate toilet seats of varying thicknesses, adhesive strips to attach the base to the top surface of the toilet seat and suction cups. In every embodiment the urine deflector is attached to the toilet seat and thus requires the user's position to be adjusted relative to the attached and fixed deflector, for optimal urine containment. In the clip and clamp embodiments, the deflector can only be advanced a limited amount towards the patient, meaning that it may well be mispositioned with the only remedy being moving the patient. Essentially once the device is attached to the toilet seat, then the user has to be positioned relative to the deflector. For the adhesive strip embodiment, the adhesive attachments will attach at the first surface they encounter, which may not be where the optimum position is. Since the patient's legs are likely to be in the way the device is likely to be stuck in the wrong place, again requiring that the patient be moved. Multiple embodiments with various modes of attachment are required to accommodate the variety of circumstances in which the device might be used.

Without the ability to easily and quickly adjust the position of the deflector it can be hard to ensure good urine containment. Because the deflector is fixed to the toilet seat, it may be difficult to ensure a close covering of the patient with the deflector as may be needed to contain the urine stream emanating from the patient without additional manipulation of the user's position. Moving the user to make last minute adjustments can be difficult for a caregiver.

SUMMARY OF THE INVENTION

What is desired is a urine deflector which is easy to use and effective in deflecting the urine stream into a lower receptacle such as a toilet bowl or a commode pail/pan, located beneath an individual. An aspect of the present invention is a means to keep the deflector in place relative to the position of the user during urination while at the same time allowing the position of the deflector to be easily adjusted before urination relative to the toilet or commode seat. Preferably such a device would be useful in many different contexts, such as conventional toilet seats, and commode seats with or without a cross brace member. Preferably such a device will allow a caregiver, attendant or user of the device, to quickly and effectively position the deflector relative to the user to ensure reliable urine stream deflection, regardless of the relative sizes of the caregiver and the user. Most preferable the device will be able to be positioned by the caregiver, attendant or user, and will be easily adjusted to suit the user's position while at the same time being retained securely in place once so positioned and during urination. As well, most preferable the device will be put into position only after the user is seated and in this way will not present a fixed obstacle, over or around which the user must be transferred or transfers him or herself. In a preferred aspect the present invention can be easily and reliably held in a secure position during use to reduce the risk of a loss of containment of the urine or the like on a range of toilet or commode seat configurations.

For seated users, what is required is to contain and direct the urine stream down, once the user is positioned sitting on the toilet, commode chair or other urine containment device. The present invention provides a urine deflector, the upper portion of which is placed in front of the user and in between the user's legs, after the user is in a seated position. The deflector of the present invention is not attached to the toilet seat. In this way the present invention can be positioned from a distal to a more proximal position relative to the user. The present invention can be placed against the user's body and directly in front of the user's genitals to ensure good containment of the urine stream. The present invention further comprehends that the deflector can be temporarily but reliably secured in place between the user and the toilet seat or other seat that the user may be seated upon, such as a commode seat. In a preferred embodiment, two weight-bearing projections are provided on the deflector, one for fitting under each leg of the device user. The projections are secured between the top surface of the toilet or commode seat and the medial aspect of the underside of the user's legs.

The weight of the device-user's legs then traps the deflector in place to keep it secure. The position of the deflector can be easily adjusted to the device-user's anatomy and body position as there is no attachment of the deflector to the toilet or the toilet seat. All that is required is for a caregiver, attendant or device user, to first lift, abduct or through a combination of lifting and abduction move one leg to adjust the position of the weight bearing projection under the leg of the device user and then do the same on the other leg to ensure the deflector is in the most advantageous containment position. To facilitate the positioning of the invention, the device may be rotated during this process to reduce the amount of leg abduction and lift required. In this way even a small caregiver or attendant relative to a large device user can easily and reliably position the deflector for maximum urine containment. In another embodiment, the deflector has one weight-bearing projection for fitting under one leg of the device user. The projection is secured between the top surface of the toilet or commode seat and the medial aspect of the underside of the device user's leg. The weight of the device user's leg then traps the deflector in place to keep it secure.

The urine deflector design may incorporate projections that are somewhat flexible to better conform to the top surface of the toilet or commode seat for the device user's comfort.

The urine deflector may include one or two hinged projections with hinge axes that may be horizontal or vertical allowing the projections to be pivoted out of the way and then under the legs of the user as required to secure the urine deflector in position.

Therefore, according to the present invention there is provided a urine deflector to deflect urine issuing from a seated user, said urine deflector comprising:

at least one retaining projection extending from a urine deflector body portion, said retaining projection being sized and shaped to be positioned and then held in between a medial aspect of the user's legs and a toilet seat when said deflector portion is positioned in front of said user's genitals said deflector portion further being sized and shaped to contain and direct a flow of urine emanating from said user generally downwardly, wherein said urine deflector can be held in position between said user and a toilet seat in front of said user's genitals to prevent said flow of urine from escaping beyond said urine deflector in any direction except downwardly.

According to a further embodiment of the present invention, there is provided a method of positioning a urine deflector in front of a user seated on a toilet seat comprising the steps of:

moving at least one of said user's legs laterally outwardly on said toilet seat, placing said urine deflector in a position to cover said user's genitals and to position a retaining projection on said toilet seat, and moving said user's leg back into a position on said toilet seat and said retaining projection to hold said urine deflector in place during use.

BRIEF DESCRIPTION OF THE DRAWINGS

Reference will now be made by way of example only to preferred embodiments of the invention by reference to the following drawing in which.

DETAILED DESCRIPTION OF THE PREFERRED EMBODIMENTS

Figure 1:
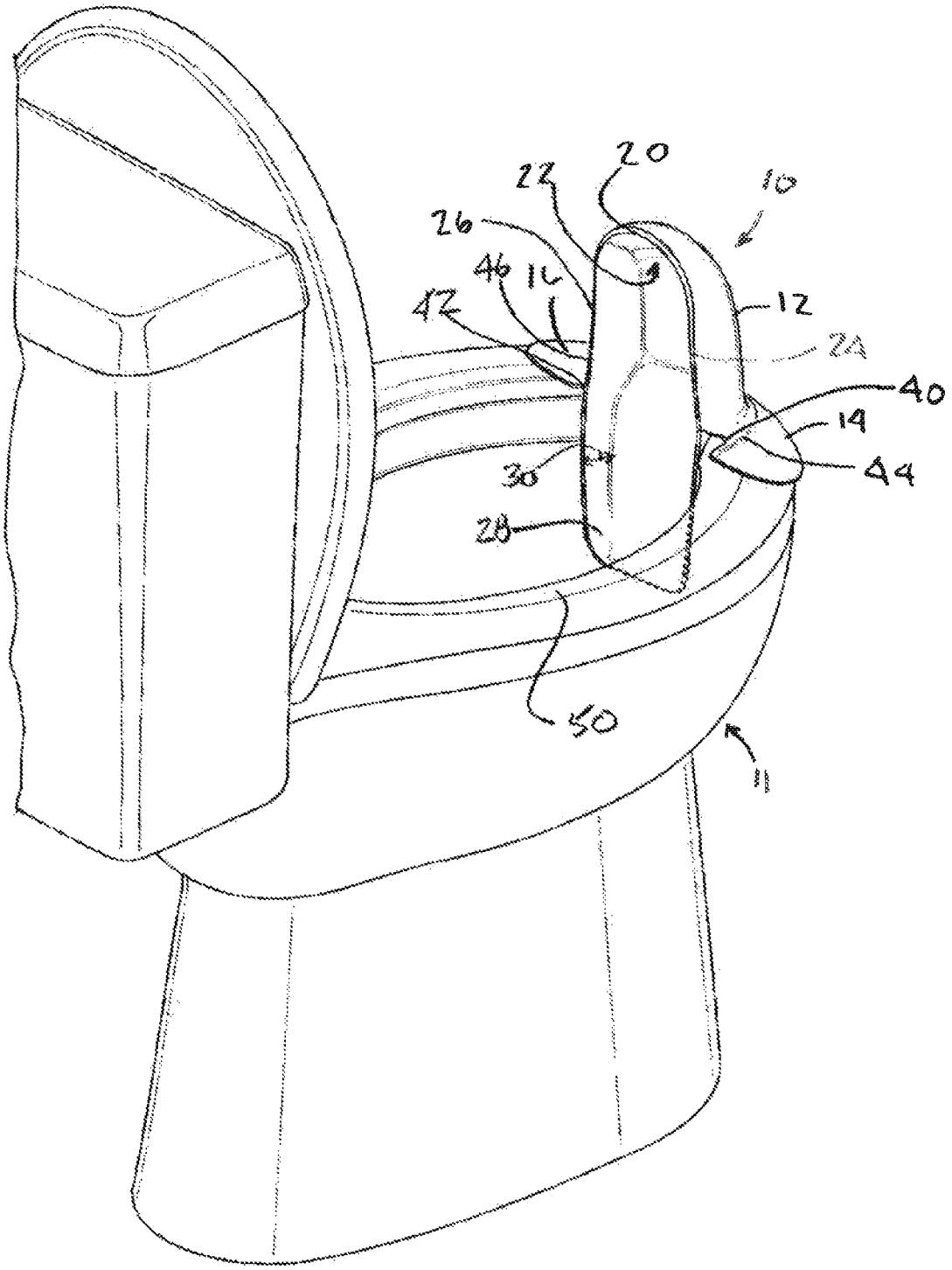
FIG. 1 is a rear % view of an embodiment of the present invention in place on a toilet seat.

FIG. 1 shows a positionable urine deflector 10 according to the present invention in place on a toilet 11. The portable urine deflector 10 includes a main body deflector portion 12 and at least one retaining projection 14. In the preferred embodiment the main body deflector portion 12 is curved, but the present invention comprehends that the main body defector portion 12 could be straight edged such as a rectangular, square or other shape that is sufficient to contain and deflect generally downwardly the urine stream emanating from a seated person as described below. In this embodiment two retaining projections 14, 16 are shown, one extending from either side of the deflector portion, which are described in more detail below. As can now be understood, the present invention comprehends that the cross-sectional shape of the retaining projections 14, 16 can vary, from wing like to round, oval or the like. All that is required is that the projection extend far enough laterally to permit it to be trapped between the medial aspect of the user's legs and the toilet seat, commode seat or the like. In this description the term "toilet seat" comprehends any type of seat including commode seats with and without cross braces, conventional toilet seats and any other pass through seating structure on which a person may be seated during urination.

In this description the term user is used to mean the person who is urinating. The term user comprehends a patient, an individual with a physical and/or cognitive disability, a child in toilet training or any other person who requires assistance to contain their urine while urinating. As can now be understood, the term user comprehends both males and females.

The curved deflector portion 12 is a preferably a gently rounded or cupped shape, and is sized and shaped to generally to deflect the urine when positioned in front of the genital region of the user. Most preferable the upper edge 20 of the deflector portion 12 can be positioned towards the body of the user and the deflector 12 curves down and away from the edge 20 with a surface 22 to limit the loss of urine from under the curved deflector portion 12 if the user is urinating in an upward direction. Most preferable the side edges 24, 26 of the curved deflector portion 12 are shaped to allow the side edges 24, 26 to also be positioned adjacent to the user to limit the loss of urine in a sideways direction.

Most preferable the urine guide element 28 of the curved deflector portion is elongated and curved in shape to allow there to be a side portion 30 between the user and the deflector 10 to allow the deflected and contained urine to be guided down and to drain by gravity into a receptacle below, such as a toilet bowl or commode pan or the like, by means of an extended guide surface 28.

Extending laterally from the curved deflector portion 12 of the positionable urine deflector 10 are two retaining projections 14 and 16. Most preferably the projections are thin and smooth, in some cases the surfaces may be textured for grip, and can be comfortably placed under the legs of the user as the user is sitting on a toilet seat or the like. The projections take the form of wings which most preferably are wing shaped in plan, and comfortably thin in cross-section, to facilitate being comfortably positioned under the user's legs and conform to the underlying surface. A smooth top surface also aids in allowing the projections to be moved relative to the user.

Most preferably, notches 40, 42 are formed at the base 44, 46 of each projection 14 and 16. The notches enhance the flexibility of the connection of the projections 14 16 to the curved deflector portion 12, by reducing the amount of material present at the connection point. The reduced amount of material can be made in any direction, in the nature of a groove along the top or bottom surfaces or both, instead of the form of notches shown. However, notches 40, 42 are preferred to help the rear portion of the projections bend with the seat contour. In a most preferred form of the invention, the retaining projections are flexible and conform to the interface between the medial aspect of the user's legs and the toilet seat, no matter what position on the toilet seat is required to suit the user's needs. What is comprehended is to provide a degree of flexibility to the retaining projections 14, 16 to allow the deflector to deform under the weight of the user's legs according to the inclined nature of the toilet seat 50, to make the device both more comfortable for the user and to tilt the top edge 20 towards the user for better urine containment. Many toilet seats are provided with a curved or slightly cupped upper surface to comfortably support the undersides of the legs of the user. By being flexible, the projections 14, 16 can temporarily deform (i.e. temporarily bend) to the contours of the toilet seat without digging into the legs of the user, making the device both better positioned and more comfortable for the user. The present invention further comprehends a single use disposable embodiment which may permanently deform for the user's comfort. In the reusable embodiment, the notches 40, 42 also allow the side walls of the deflector to flex inward thereby conforming to the user's inner thighs for added comfort.

Extending below the wings is the urine guide element 28 which is gently rounded to deflect the urine downwardly. The guide element 28 extends far enough below the projections 14, 16 to permit the contained liquid urine to shed off the deflector at a level well below the upper edge of the receptacle upon which the user is sitting, and therefore well clear of the user and well within the receptacle.

Figure 2:
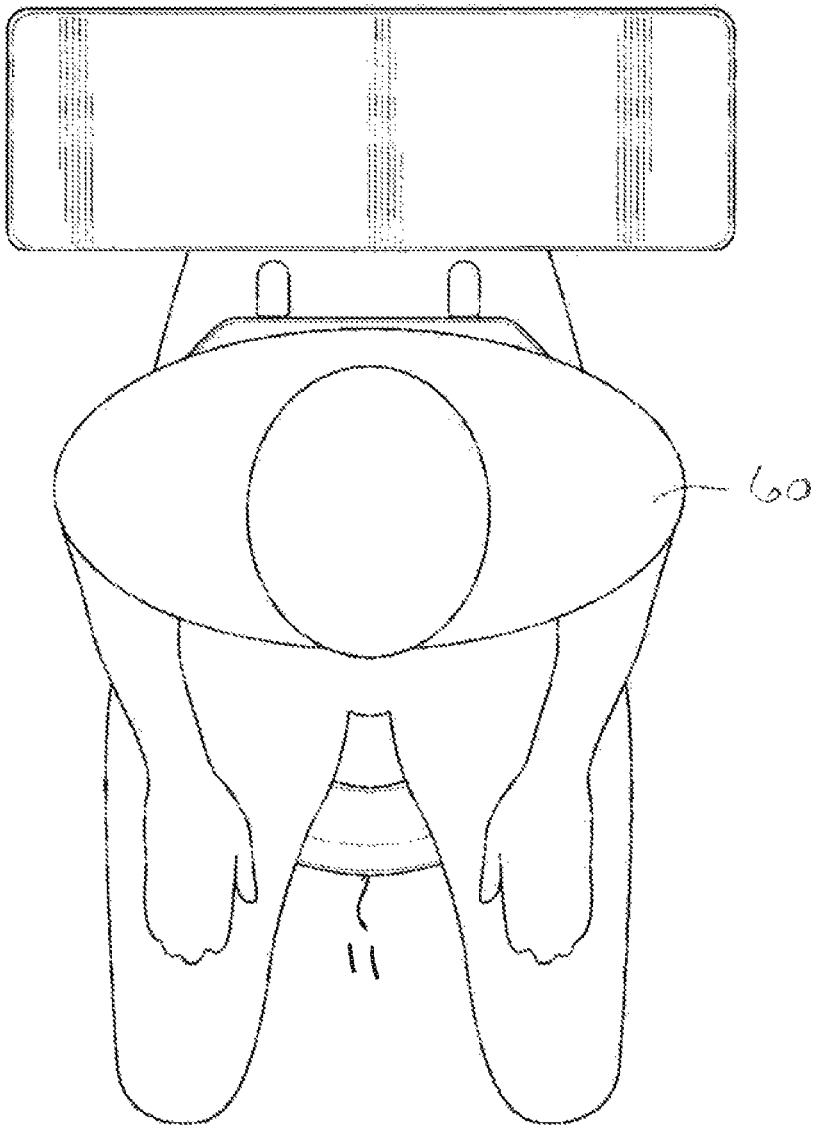
FIG. 2 is a top view a device user seated on a toilet seat before placement of the present invention.
Figure 3:
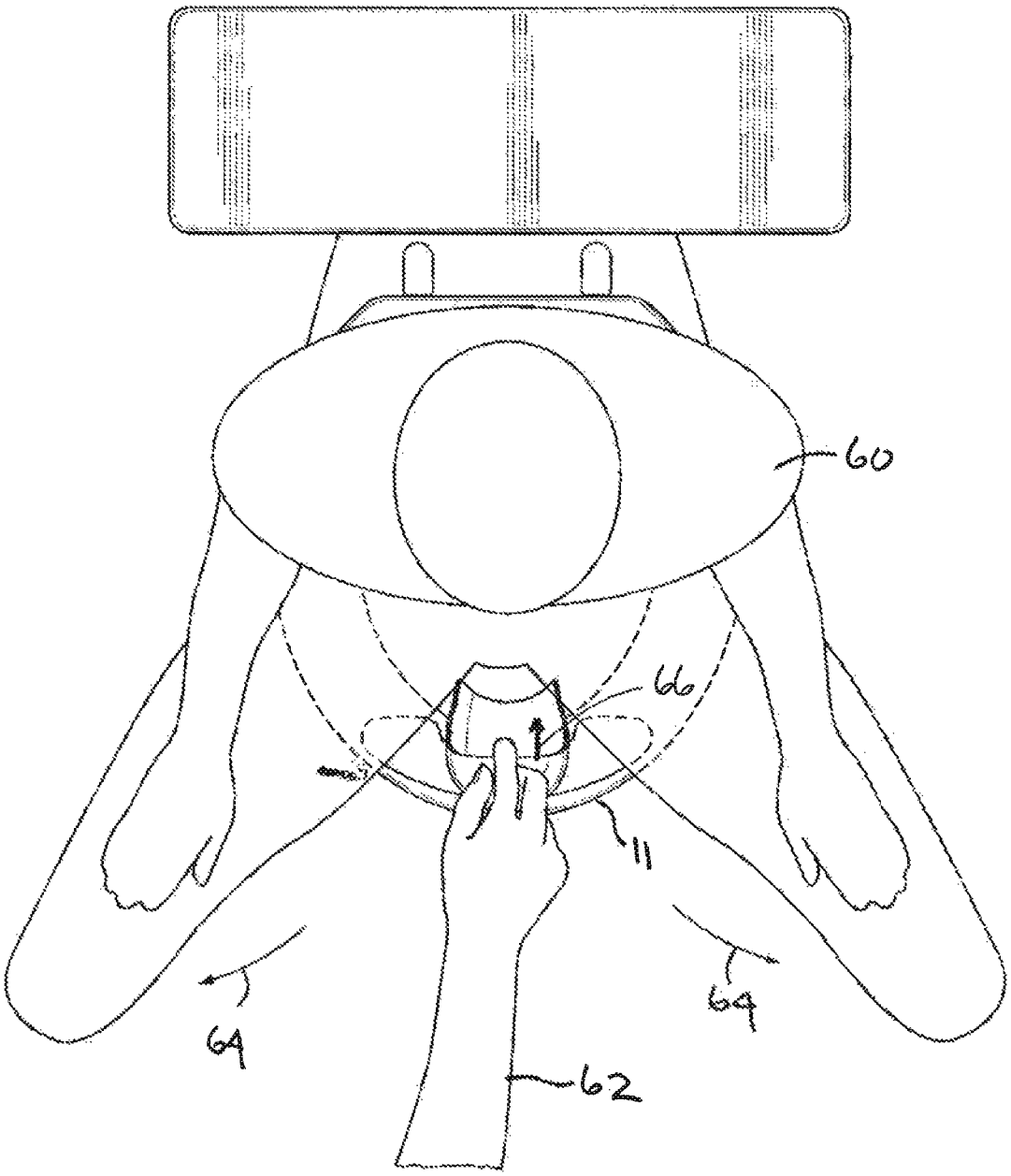
FIG. 3 is a top view of the embodiment of the present invention of FIG. 1 being positioned between the legs of the device user of FIG. 2.
Figure 4:
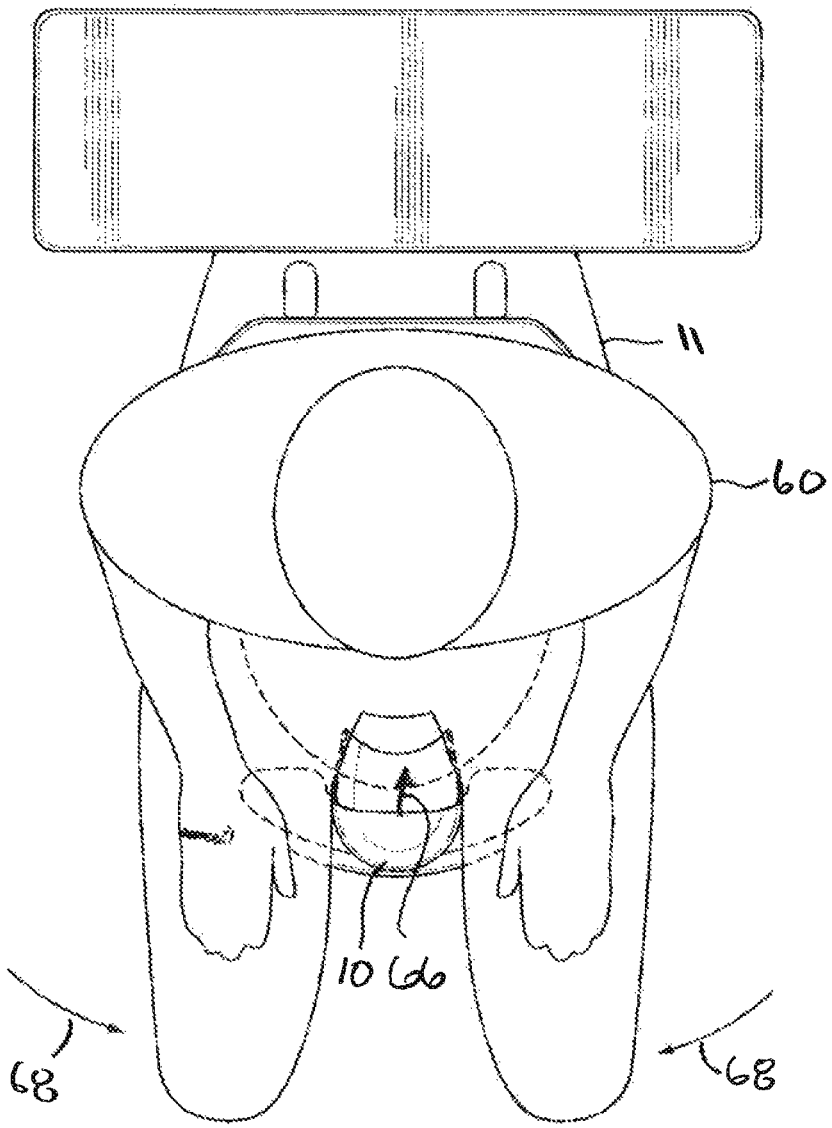
FIG. 4 is a top view of the device user of FIG. 3 with the present invention located in position and being held by the device user's legs.

The use of the present invention can now be better understood. As shown in FIG. 2, the user 60 is positioned over the toilet or commode seat without any obstruction, because the present invention is not yet deployed. As shown in FIG. 3, once the user is in position on the toilet 11, the caregiver 62 can spread the users legs (shown by arrows 64 in FIG. 3), or gently lift one leg to slide one of the projections 14, 16 or wings under the user's leg. As the leg is lowered the weight of the user's leg will cause the projection to deform to match the contour of the underlying toilet or commode seat, which will provide additional comfort while the weight of the user's legs hold the device in place. Once one side is in position, then the other leg can be raised slightly and/or moved laterally, and the other projection or wing positioned under this leg. As this second leg is lowered, then this other projection will also flexibly deform to match the contours of the toilet or commode seat surface. Then the caregiver, attendant or user can readjust the position of the device for optimum urine containment. In this position the rounded deflector portion will be in position anterior to the genital region of the patient. In FIG. 4, the user is shown with legs having been moved into position on top of the wings as indicated by arrows 68. It will be appreciated that the exact combination of leg lifting and or abduction used to position the present invention in front of the user may vary from user to user depending upon the nature of the user's physiology and the nature of their impairment, if any. However, all that is required is for the users' legs to be resting on the projections to hold the device in position during use.

Figure 5:
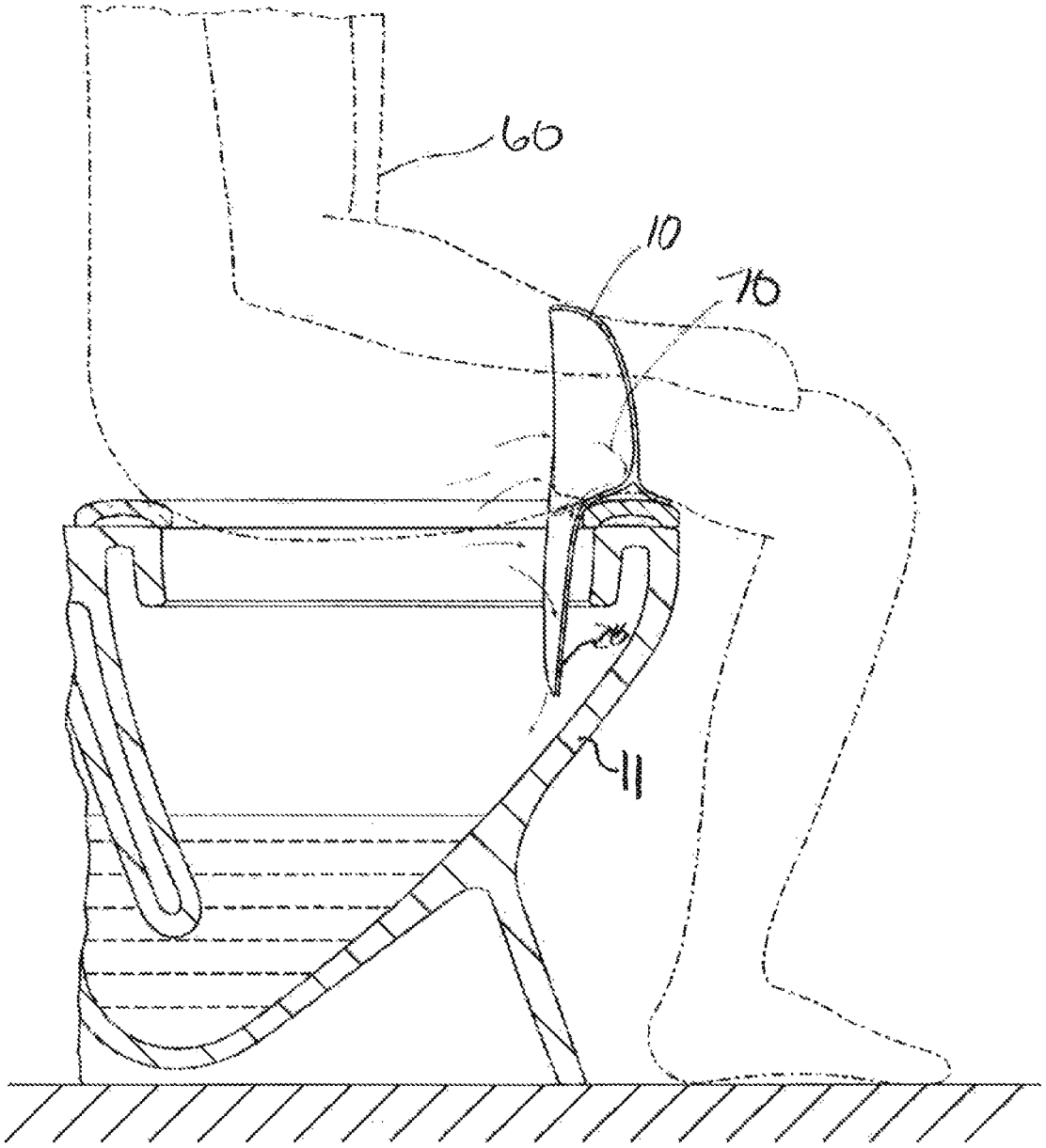
FIG. 5 is a side view of the device user using the present invention, which is shown in cross section.

FIG. 5 shows the present invention in the use position. The user can then urinate with the urine stream 70 being contained and deflected by the main curved body portion of the invention 10. From there the urine flows by gravity downwardly inside of the urine guide element 28. Once the user has completed urinating the caregiver, attendant or user can remove the deflector from between the user's legs. By being able to handle the deflector by the wings, or the front and outside surfaces of the deflector, the caregiver, attendant or user will not be in contact with the surfaces exposed to the urine and can simply remove the deflector from between the patient's legs for cleaning and storage.

Most preferably the present invention will be made from an inexpensive yet durable and flexible plastic material that is both easy to mold and yet durable in the presence of the caustic properties of urine. Most preferably the material will be easily cleaned, sanitized or sterilized. Further the material needs to be smooth so as not to create any discomfort when placed under the leg and next to the skin of the patient. Although a number of plastic materials are possible, good results have been achieved with polypropylene. Other materials comprehended include PVC, silicone and PET as these are suitable sterilizable plastic materials; as well as single use disposable materials such as recycled paper products and the like.

Figure 6:
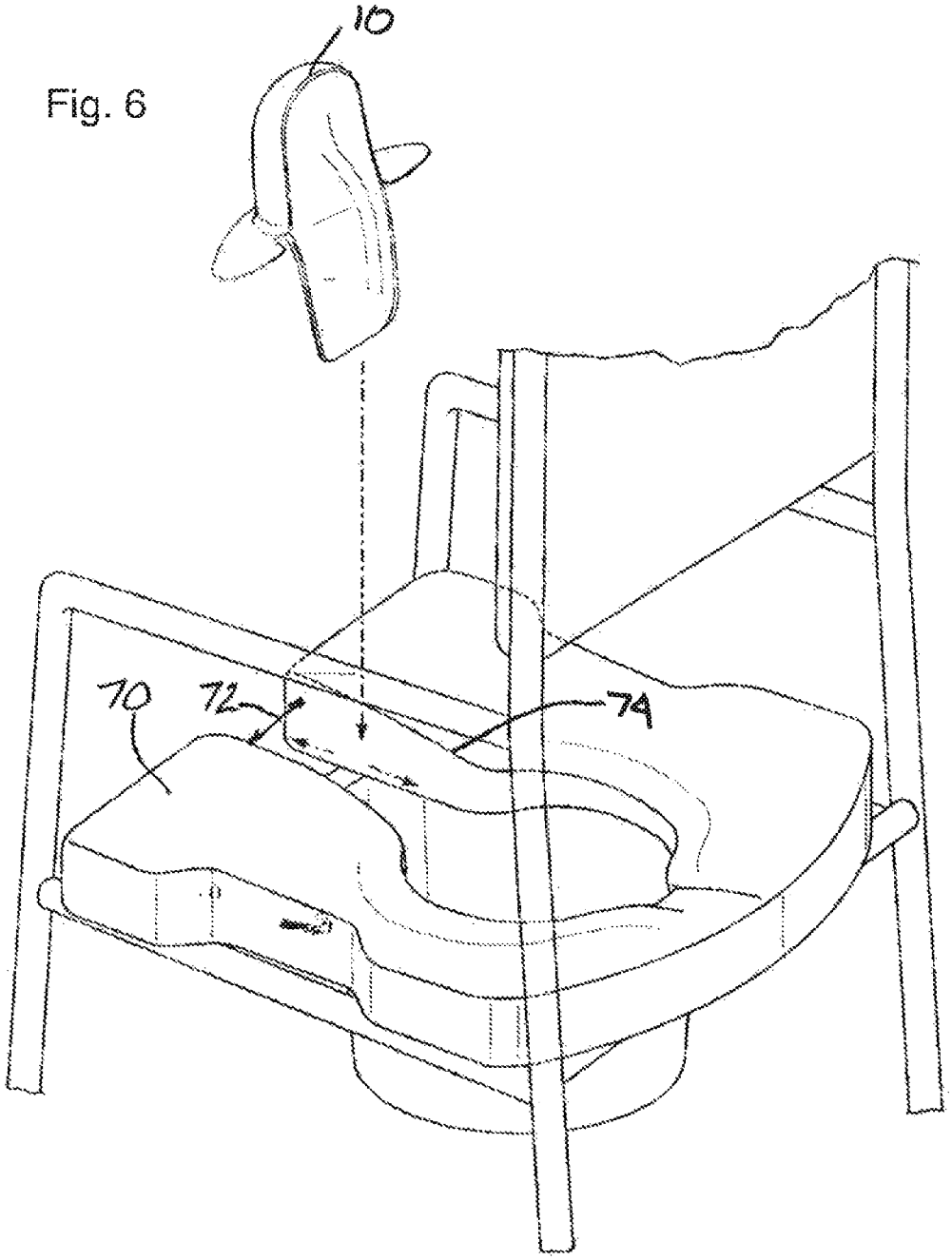
FIG. 6 is a view of the present invention being positioned on a first form of commode seat, shown without device user for clarity.

FIG. 6 shows the present invention 10 placed on a form of commode seat 71. It can be seen that even though the commode seat is of a much greater thickness than as shown on the toilet seat 50, because the deflector 10 is designed to sit onto the top surface of the commode seat, while the urine guide element 28 of the device extends far enough downward to guide urine into the receptacle. There are no additional structures or features required to adapt the device 10 to use on this form of seat. In this case the projections 14, 16 extend laterally to span the gap 72 formed in the commode seat. The flexible design of the device, specifically the wings, allows the device to sit optimally on the seat by conforming to the top surface of the seat. Again, due to the flexible nature of the deflector 10 this is accomplished without any discomfort to the user who has trapped the projections under their legs.

Figure 7:
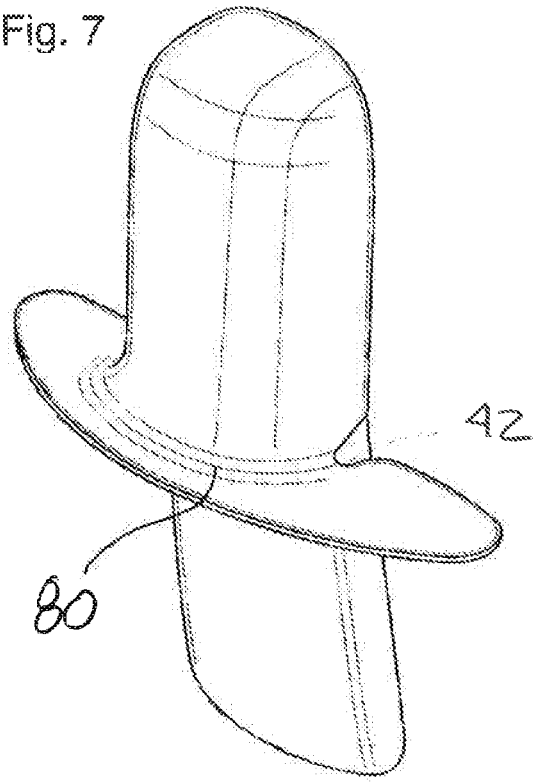
FIG. 7 is a front view of the present invention.

FIG. 7 shows a front view of the present invention 10 which shows the smooth rounded contours 80 between the projections and the main body, again which makes the device comfortable against the skin of the legs of the user. Also, the notch 42 is more clearly visible in this view.

Figure 8:
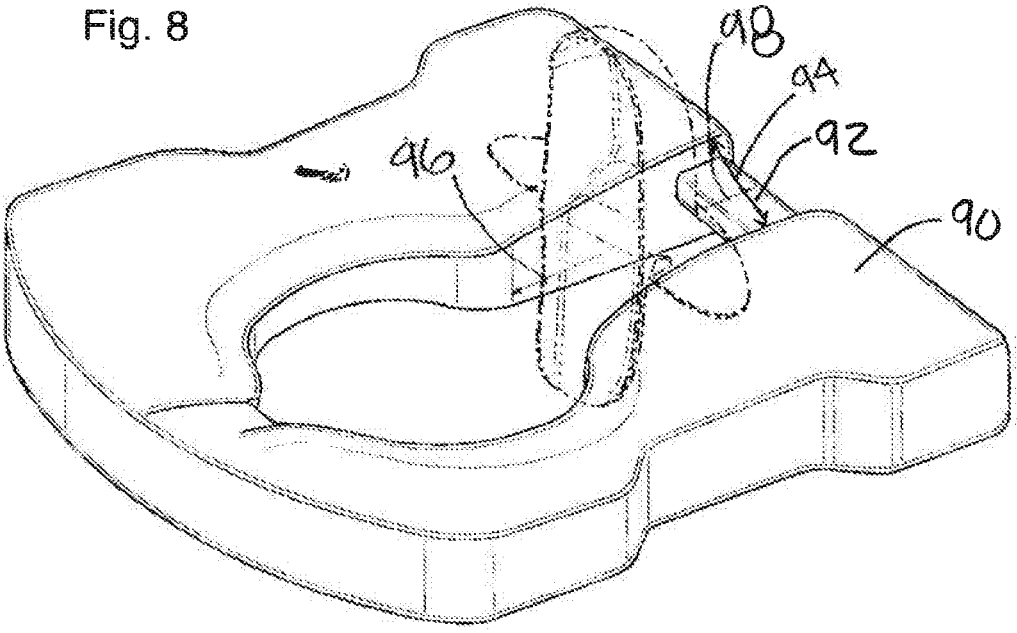
FIG. 8 is a ¾ rear outline view of the present invention in position on a different type of commode seat with a cross member across the front of the commode seat.

FIG. 8 shows the device in dotted outline in position on a different form of commode seat 90, of the type having a cross member 92. As can be seen, the present invention is easily adapted to use on this form of seat as well and can be moved rearward and forward within the gap 94, for optimal placement for urine containment, as shown by arrows 96, 98.

Figure 9:
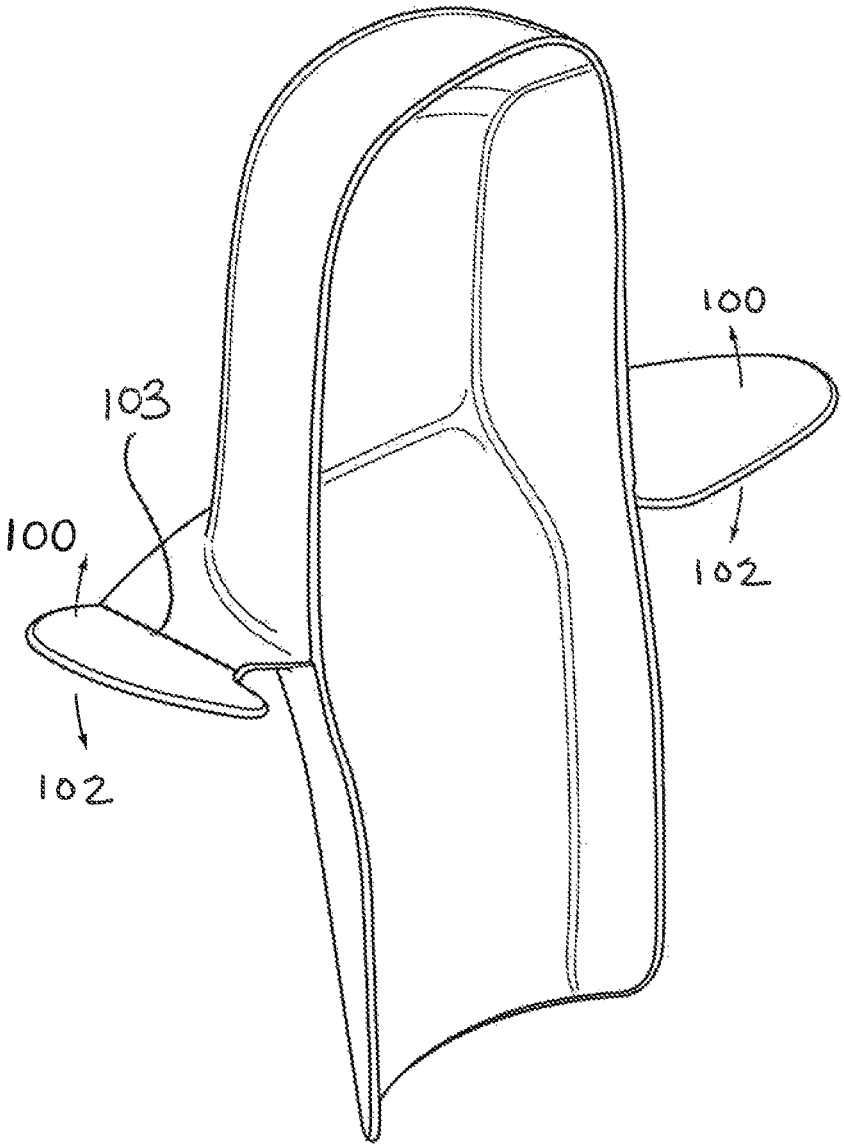
FIG. 9 is a view of a second embodiment according to the present invention.

FIG. 9 shows a further embodiment of the present invention in which the retaining projections are hingedly connected to the deflector portion. The hinge axis permits the retaining projections to be pivoted first upwardly in the direction of arrows 100, out of the way, until the deflector portion is in place relative to the user. Then the projections can be pivoted down in the direction of arrows 102, one at a time if there are two retaining projections, one on each side, and positioned under each leg of a user. The hinge can be made from various hinge structures, but a living hinge 103 provides reasonable results. In particular, the living hinge 103 will not likely accidentally pinch the skin of the user. While hinging the retaining projections in an upwardly direction is most preferred, the present invention comprehends hinging the retaining projections in the opposite direction as well, although this would make it more awkward to position in place.

Figure 10:
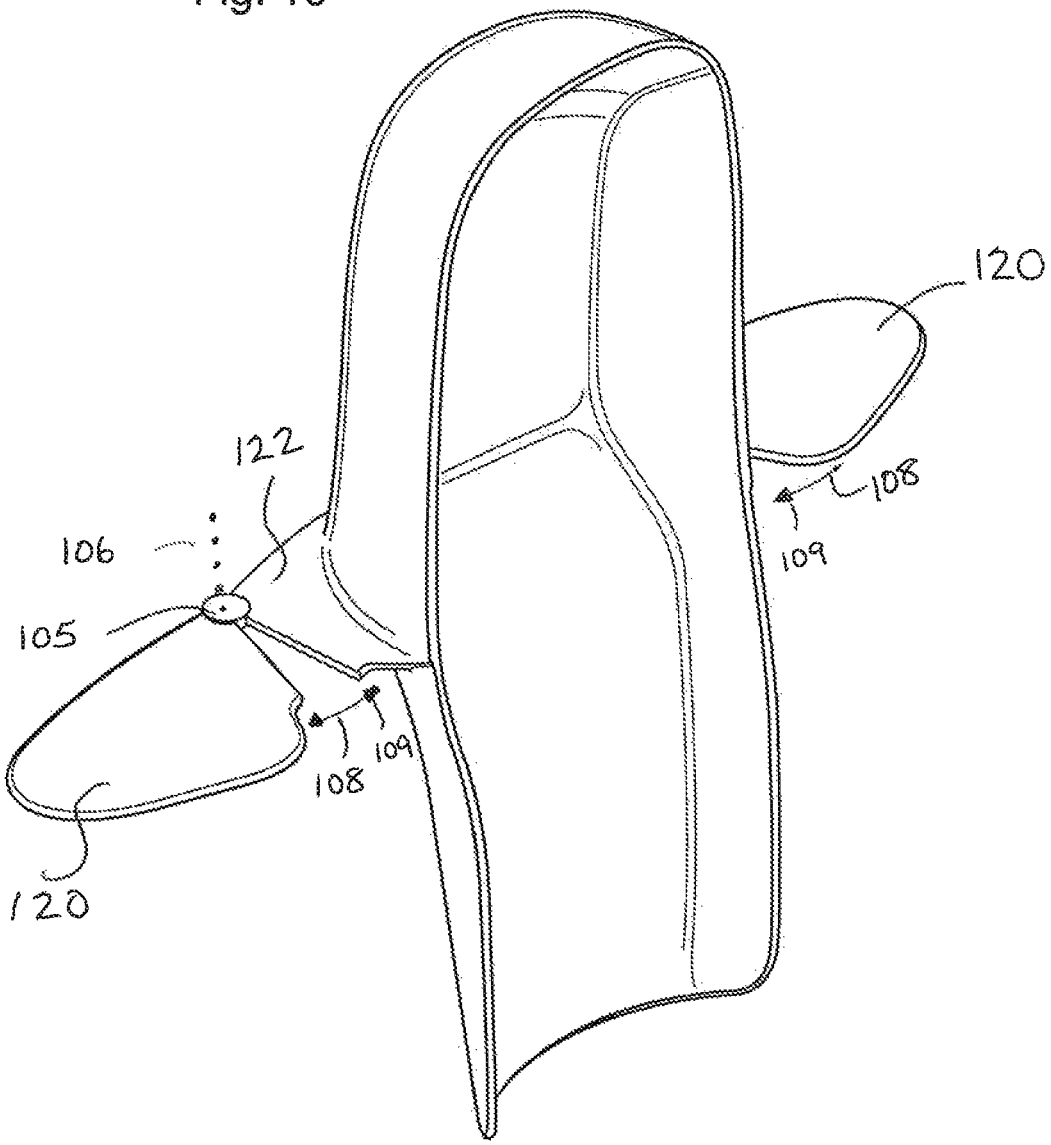
FIG. 10 is a view of a third embodiment according to the present invention.

FIG. 10 shows a further embodiment of the present invention with a different form of pivoting retaining projection having a hinge pin 105. The hinge pin 105 connects a rotating tip portion 120 to a stationary base portion 122. In this form a hinge axis 106 is generally vertical allowing the projections to be pivoted around the front of the deflector body portion in the direction of arrows 108 and thus out of the way. In this version, the pivoted tips projections may be also used as a handle to help orient the deflector in position, and then hinged back in the direction of arrows 109 to a position under each of the user's legs. Of course, the legs must be moved out of the way, such as by being gently lifted and then placed back on top of the retaining projection as described above when the same is back in position. In this embodiment, care is required not to pinch the skin of the user accidentally in returning the retaining flanges to the retained position under the users' legs. The present invention also comprehends pivoting the retaining projections towards the user, but again this is less preferred as it makes it more awkward to get the deflector in the correct position relative to the user.

The features and advantages of the present invention can now be better understood. The one design of the present invention can be used universally without the need for additional attachment features in association with a wide variety of toilet seats including commodes, regular toilet seats and the like. The wings extend far enough that even different commodes from a wide variety of manufacturers can be accommodated. The flexibility and ease of positioning of the present invention under the legs of the user enhances the urine containment properties and efficacy. The smoothly contoured nature of the device ensures that it is comfortable against the skin of the user and easy to quickly put into place. The built-in flexibility of the wings aided by both the selection of resilient plastic materials and the notched design allow the device to be deflected and contour to the surfaces of a wide variety of seats. The preferred plastic is capable of being both chemically or heat sanitized for repeated use with multiple users or sanitized for single-user applications. A stiffer plastic material can be made flexible through the uses of the notches as described above.

The present invention also comprehends the use of anti-splash features which can be added to the inside surface 22 of the deflector body 12.

Although various alterations and modifications have been discussed above by way of example only, the invention is only limited by the scope of the appended claims. For example, a number of types of plastic can be used as long as they can be easily cleaned for single-patient use or sterilized for multi-patient use. Disposable materials can also be used for single use applications.

The embodiments of the invention in which an exclusive property or privilege is claimed are defined as follows:

1. A urine deflector to deflect urine emanating from a user seated, on a toilet seat, said urine deflector comprising:

a urine deflector body portion sized and shaped to direct a flow of said urine emanating from said user in a generally downwardly direction when said deflector is positioned in front of said user's genitals;

at least one retaining projection extending from said urine deflector body portion, said at least one retaining projection being sized and shaped to be clamped between a medical aspect of the user's legs and said toilet seat, to hold said urine deflector body portion in said position in front of said user's genitals only by said clamping between the user's leg and the toilet seat.

2. The urine deflector of claim 1 further including two retaining projections extending laterally from said urine deflector body portion, one for being clamped between a medial aspect of each leg of the user and said toilet seat.

3. The urine deflector of claim 2 wherein the retaining projections are flexible to conform to a surface of the toilet seat for the comfort of the user.

4. The urine deflector of claim 3 wherein the projections are smoothly contoured for the comfort of the user.

5. The urine deflector of claim 1 further including a guide surface on said urine deflector body portion to allow the contained urine to flow by gravity into a receptacle below.

6. The urine deflector of claim 1 wherein said at least one retaining projection includes a hinge to permit said retaining projection to be hinged out of the way as the urine deflector is being positioned relative to the user.

7. The urine deflector of claim 6 wherein said hinge is a living hinge.

8. The urine deflector of claim 7 wherein said living hinge permits an outer tip of said at least one retaining projection to be rotated towards a top of said urine deflector body.

9. The urine deflector of claim 6 wherein said hinge includes a hinge pin having a generally vertical hinge axis when said deflector is being positioned relative to said user.

10. The urine deflector of claim 9 wherein said at least one retaining projection includes a pivoting tip portion and a stationary base portion connected by said hinge pin.

11. The urine deflector of claim 10 wherein said pivoting tip portion can be pivoted in front of said urine deflector body portion to allow said urine deflector to be positioned close to said user, and then pivoted outwardly to a position between the toilet seat and the medial aspect of said user's leg.

12. A method of positioning a urine deflector in front of a user's genitals when said user is seated on a toilet seat, said method comprising the steps of:

moving one of said user's legs laterally outwardly on said toilet seat, placing said urine deflector on said toilet seat with a urine deflector body portion of said urine deflector positioned in front of said user's genitals, and at least one retaining projection of said urine deflector contacting a top surface of said toilet seat, moving said user's leg laterally inwardly over said retaining projection of said urine deflector to hold said urine deflector body portion in said position, said at least one retaining projection being sized and shaped to be clamped between a medial aspect of said user's leg and said toilet seat such that said urine deflector is held in position only by said clamping between the user's leg and said toilet seat, and wherein said urine deflector is positioned in front of said user's genitals, said urine deflector body portion directs a flow of urine emanating from said user in a generally downwardly direction.

13. The method of claim 12 further including the steps of moving both of said user's legs laterally outwardly on said toilet seat to make space to position opposed retaining projections on said toilet seat, and moving said user's legs back inwardly to hold said retaining projections between the medial aspect of said user's legs and the toilet seat.

14. The method of claim 13 further including the step of pivoting said retaining projections into position onto said toilet seat after said user's legs have been moved laterally outwardly.

15. The method of claim 14 further including the step of pivoting said retaining projections about a living hinge.

16. The method of claim 15 further including the step of pivoting said retaining projections about a hinge pin having a generally vertical axis.

* * * * *